US005762433A

United States Patent [19]

Cary

[11] Patent Number: 5,762,433

[45] Date of Patent: Jun. 9, 1998

[54] FLEA POWDER BRUSH

[76] Inventor: Charles A. Cary, P.O. Box 1508, Rockport, Tex. 78382

[21] Appl. No.: 778,775

[22] Filed: Jan. 6, 1997

[51] Int. Cl.[6] ..... A46B 11/02

[52] U.S. Cl. ..... 401/184; 401/151; 401/185; 401/288; 119/605

[58] Field of Search ..... 401/184, 185, 401/186, 151, 288; 119/603, 605

[56] References Cited

U.S. PATENT DOCUMENTS

| | | | |
|---|---|---|---|
| 28,375 | 5/1860 | Ingersol . | |
| 1,733,144 | 10/1929 | Walker | 401/185 |
| 2,775,401 | 12/1956 | Storrs | 401/184 |
| 2,952,027 | 9/1960 | Caldwell . | |
| 3,137,305 | 6/1964 | Jones . | |
| 4,319,852 | 3/1982 | Bell et al. | 401/185 |
| 4,799,456 | 1/1989 | Young | 119/603 |
| 4,944,625 | 7/1990 | Futter . | |
| 5,222,822 | 6/1993 | Hernandez . | |

FOREIGN PATENT DOCUMENTS

| | | | |
|---|---|---|---|
| 2366815 | 6/1978 | France | 401/185 |
| 212157 | 3/1924 | United Kingdom | 401/184 |

*Primary Examiner*—Steven A. Bratlie
*Attorney, Agent, or Firm*—Michael I. Kroll

[57] ABSTRACT

A flea powder brush (10) comprising a handle (12) to be grasped by a hand (13) of a person. A head (14) having a chamber (16) therein extends from one end of the handle (12). A structure (18) is for holding flea powder (20) on the head (14). A first facility (22) is for communicating between the holding structure (18) and the chamber (16) within the head (14). A plurality of bristles (24) extend downwardly from the head (14). A second facility (26) is for communicating between the chamber (16) within the head (14) and the bristles (24). An assembly (28) is for manually forcing some of the flea powder (20) within the holding structure (18) through the first communicating facility (22), into the chamber (16) within the head (14), through the second communicating facility (26) and into the bristles (24), so that the flea powder (20) can be brushed into the hair and hide of an animal (30).

1 Claim, 5 Drawing Sheets

58

| | Description | Ref No. |
|---|---|---|
| | Hollow Bristle | A |
| | Solid Bristles | B |

FLEA POWDER BRUSH

BACKGROUND OF THE INVENTION

1. Field of the Invention

The instant invention relates generally to dispensing devices and more specifically it relates to a flea powder brush. The brush can be grasped by one hand, while a bellows on a reservoir housing holding the flea powder can be depressed by a thumb, so that some of the flea powder can exit through hollows bristles onto the hair and hide of an animal.

2. Description of the Prior Art

Numerous dispensing devices have been provided in prior art. For example, U.S. Pat. Nos. 28,375 to Ingersoll; 2,952,027 to Caldwell; 3,137,305 to Jones; 4,944,625 to Futter et al. and 5,222,822 to Hernandez all are illustrative of such prior art. While these units may be suitable for the particular purpose to which they address, they would not be as suitable for the purposes of the present invention as heretofore described.

Ingersoll, John R.

Hair-Brush

U.S. Pat. No. 28,375

A brush provided with an elastic reservoir, so that by compression of some parts thereof the liquid will be injected into the brush and herein shown and described.

Caldwell, Charles W.

Dispensing Brushes

U.S. Pat. No. 2,952,027

A dispenser brush comprising, a combination, a container of resilient material. A bottom portion of the container has a bottom wall containing apertures and having brush elements extend downward from the bottom wall. A top portion of the container telescopes downwards about the bottom portion and has a top wall. A tongue is cut from the top wall. An upper seal is slideably telescoped downwards within the bottom portion. An inner piece formed of porous, resilient material has a base which extends over the bottom wall. A smaller upper portion extends upward within the container to the upper seal. The smaller upper portion is deformed and exerts an upwardly force on the upper seal as the seal is forced downward by depressing of the tongue.

Jones, Alfred H.

Dispensing Comb Apparatus Having Removable Dispensing Means

U.S. Pat. No. 3,137,305

Dispensing comb apparatus comprising a body means having a cavity formed therein. A plurality of spaced teeth are attached to the body means and extends therefrom. The body means has a plurality of openings formed therein. The openings are formed between the teeth. The body means has passage means formed therein to provide communication between the cavity and the openings. A removable dispensing means is disposed within the cavity and includes a dispensing nozzle formed at one end thereof. A means for positively seating and sealing the nozzle with respect to the surrounding structure such that the nozzle communicates only with the passage means. A control means is adapted to engage a portion of the dispensing means remote from the nozzle for dispensing material from the dispensing means. The comb apparatus also includes a clip-on cover means having a plurality of projects formed thereon. Each of the projections fit within one of the openings in the body means when the cover means is disposed in an operative position relative to the body means.

Futter, Menachem

Wwilson, James E.

Golden, Annette M.

Powder Applying Brush

U.S. Pat. No. 4,944,625

A powder-dispensing brush of the pressure-feed type employs a self-cleaning filter which performs an anti-clogging function, as well as a filtering function. The brush also employs a valve which can be switched between an on position and an off position, in order to control the dispensing of powder from the brush.

Hernandez, Javier

Dispensing Device for Particulate Material

U.S. Pat. No. 5,222,822

A particulate material dispensing assembly comprises a container for storing particulate material and includes an end cap device having a passageway for discharging the particulate material. The end cap device is disposed at a discharge end of the container and includes a removably mounted brush. The container includes a base section, a delivery section and a collapsible resilient coupling section connecting the base section to the delivery section.

SUMMARY OF THE INVENTION

A primary object of the present invention is to provide a flea powder brush that will overcome the shortcomings of the prior art devices.

Another object is to provide a flea powder brush that is a hair brush with a bellows having a one-way air valve thereon, which can be hand pumped to force the flea powder in a reservoir housing down through hollow bristles to reach an animal's hide.

An additional object is to provide a flea powder brush which is adapted to serve a dual function of an animal hair brush, as well as a dispenser for dispensing the flea powder onto the hair of the animal for a deeper application thereof.

A further object is to provide a flea powder brush that is simple and easy to use.

A still further object is to provide a flea powder brush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
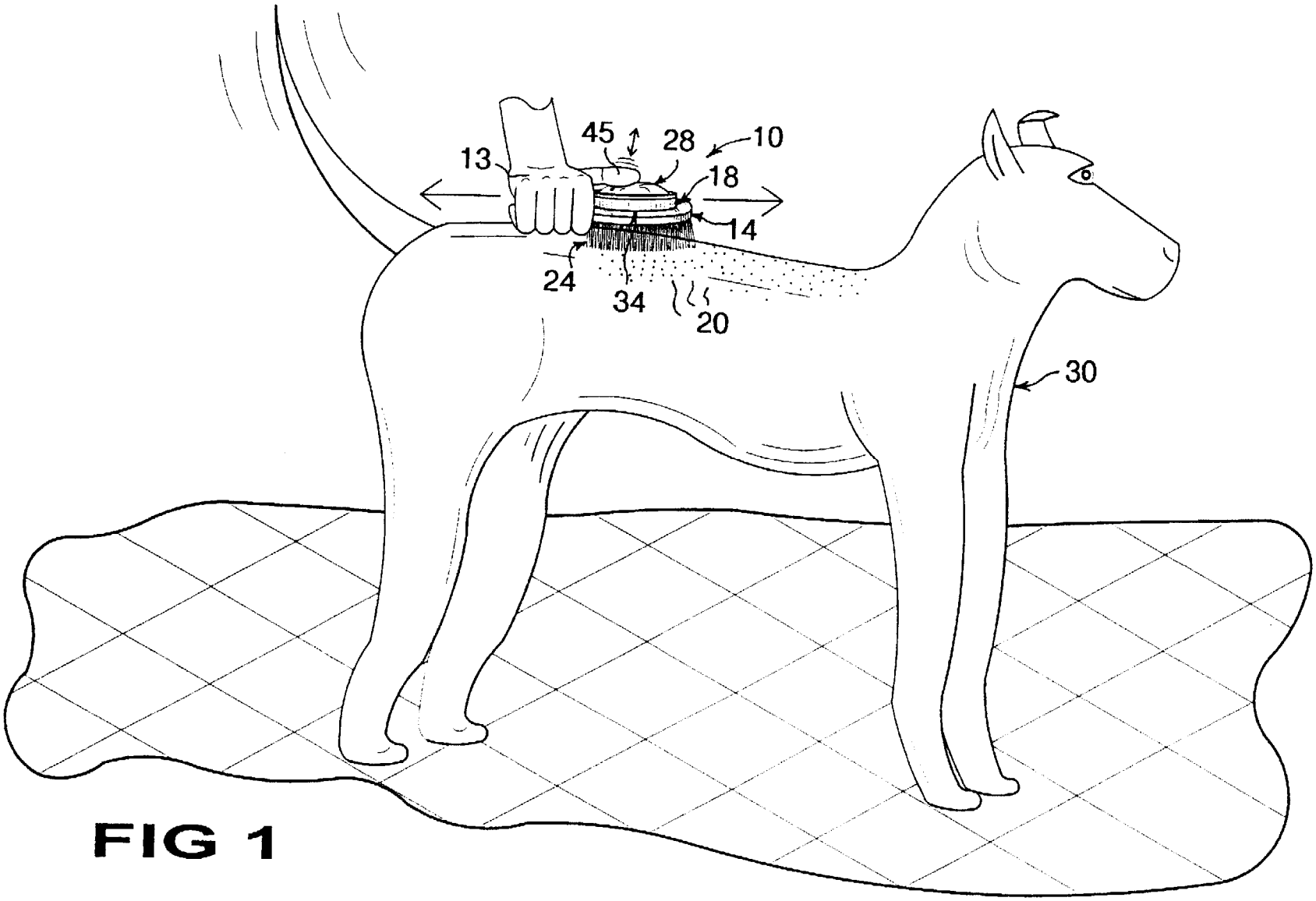
FIG. 1 is a perspective view showing the instant invention being used to apply flea powder into the hair and hide of an animal.
Figure 2:
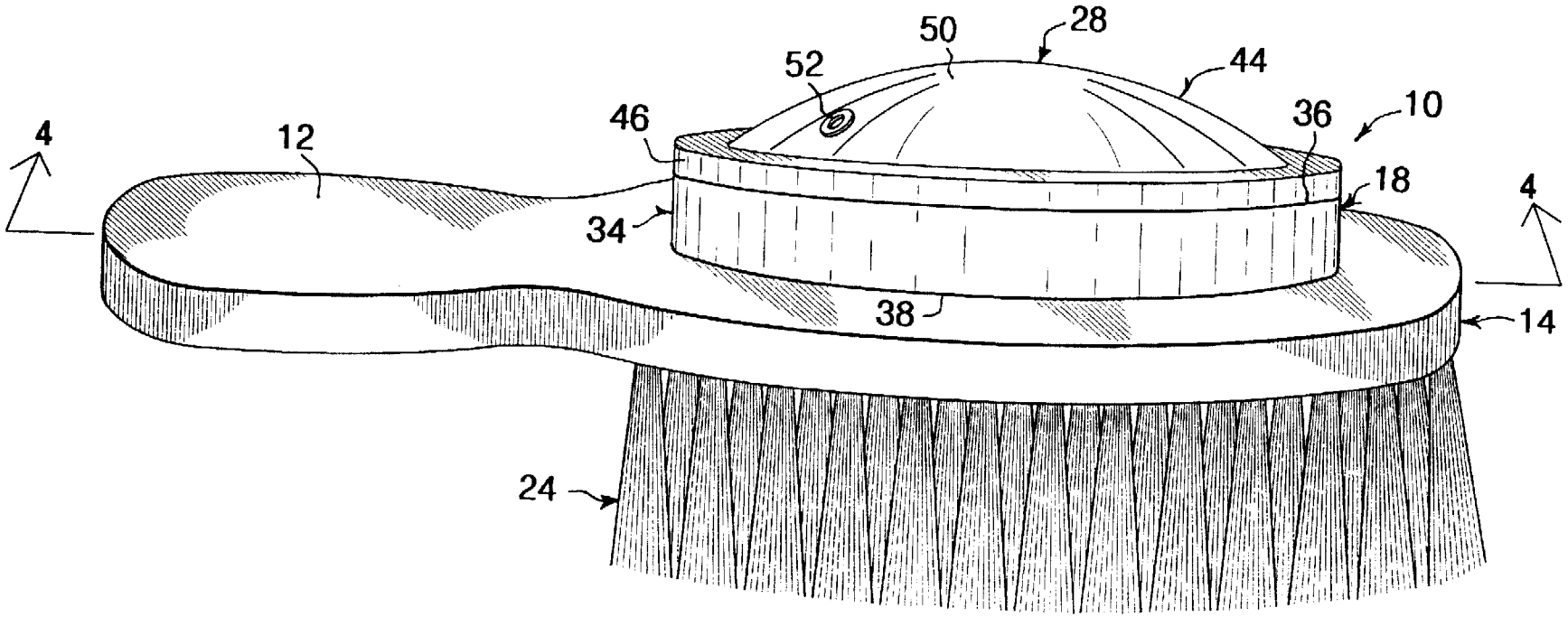
FIG. 2 is an enlarged perspective view of the instant invention per se.

Turning now descriptively to the drawings, in which similar reference characters denote similar elements throughout the several views, FIGS. 1 to 4 illustrate a flea powder brush 10 comprising a handle 12 to be grasped by a hand 13 of a person. A head 14 having a chamber 16 therein extends from one end of the handle 12. A structure 18 is for holding flea powder 20 on the head 14. A first facility 22 is for communicating between the holding structure 18 and the chamber 16 within the head 14. A plurality of bristles 24 extend downwardly from the head 14. A second facility 26 is for communicating between the chamber 16 within the head 14 and the bristles 24. An assembly 28 is for manually forcing some of the flea powder 20 within the holding structure 18 through the first communicating facility 22, into the chamber 16 within the head 14, through the second communicating facility 26 and into the bristles 24, so that the flea powder 20 can be brushed into the hair and hide of an animal 30.

The handle 12 and the head 14 are integral and fabricated out of a strong durable material 32. The holding structure 18 is a cylindrical reservoir housing 34, having an open top end 36 and an open bottom end 38 affixed onto the head 14.

Figure 4:
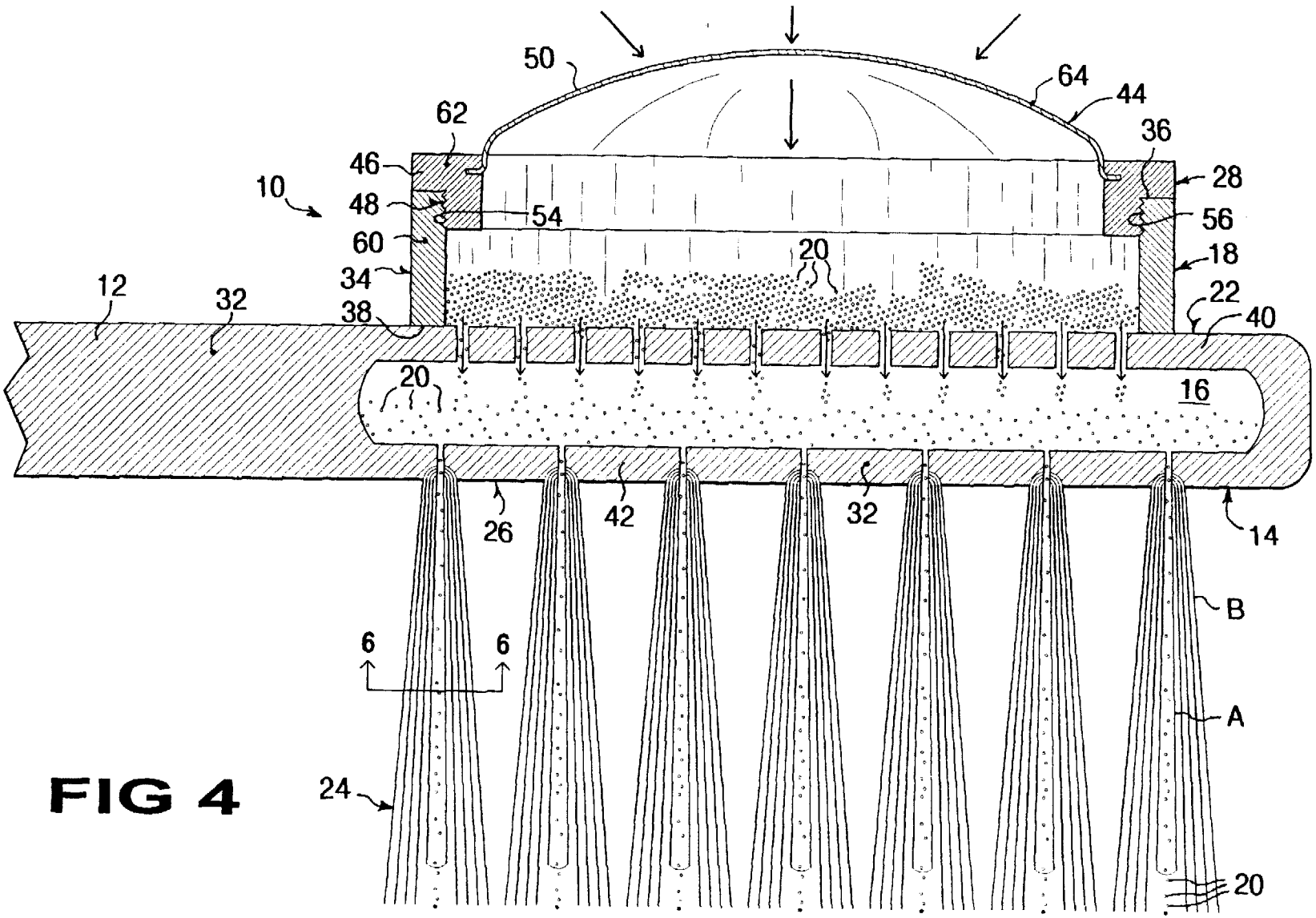
FIG. 4 is a further enlarged longitudinal cross sectional view taken along line 4—4 in FIG. 2, with the handle broken away.

As best seen in FIG. 4, the first communicating facility 22 is a perforated top wall 40 of the head 14. The second communicating facility 26 is a perforated bottom wall 42 of the head 14.

Figure 3:
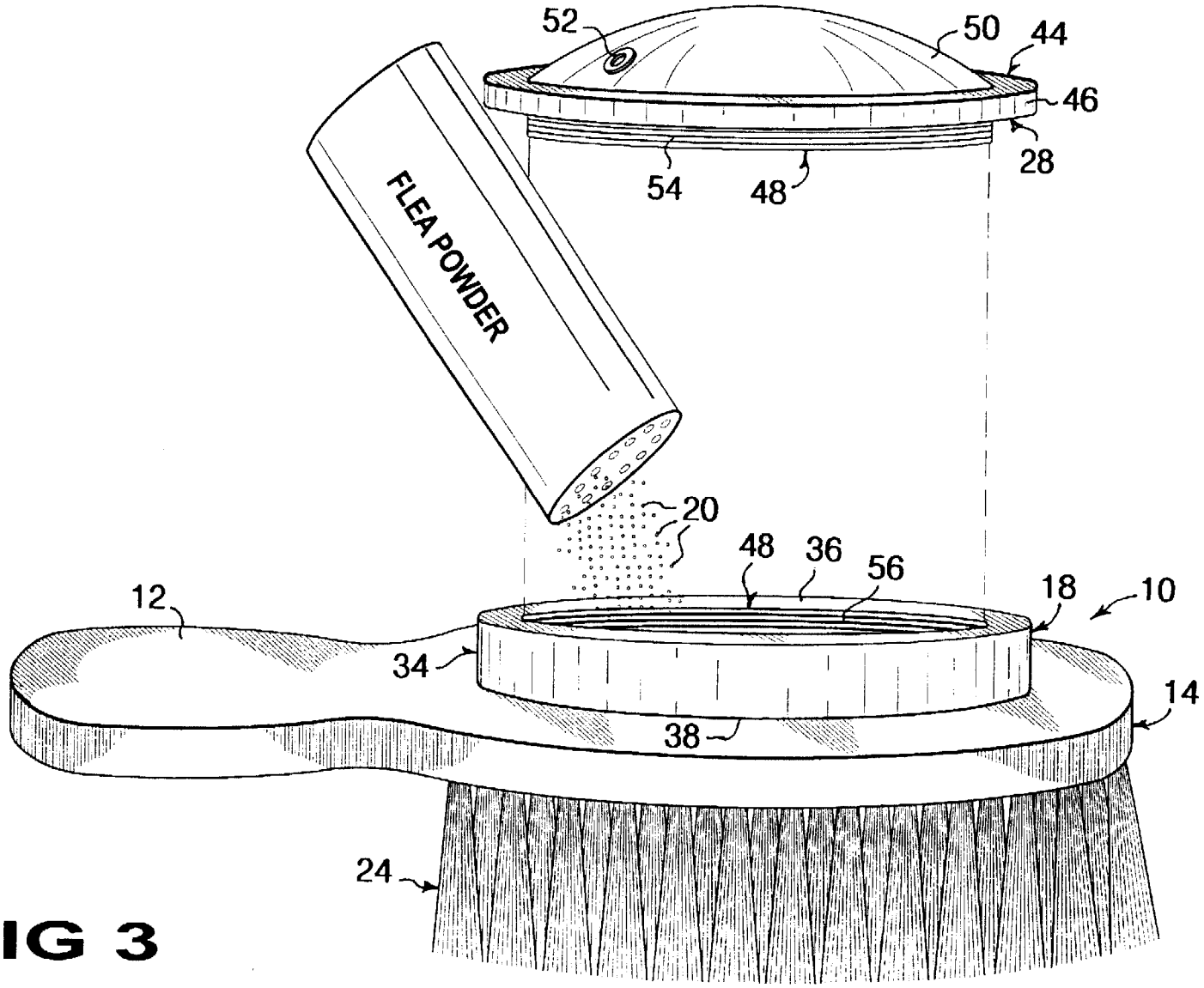
FIG. 3 is an enlarged perspective view similar to FIG. 2, showing the bellows cap unscrewed from the reservoir housing and flea powder being deposited therein.

The manually forcing assembly 28 is a bellows cap 44 on the open top end of the cylindrical reservoir 34, which can be depressed by a thumb 45 of the hand 13 grasping the handle 12. The bellows cap 44 includes a collar 46. An assemblage 48 is for engaging the collar 46 onto the open top end of the cylindrical reservoir 34 in a removable manner, so that the flea powder 20 can be deposited into the cylindrical reservoir 34, as shown in FIG. 3. A flexible convex crown 50 extends upwardly on the collar 46. The bellows cap 44 further includes a one-way air valve 52 in the flexible convex crown 50, so as to allow the flexible convex crown 50 to function as a hand pump.

The assemblage 48 consists of the collar 46 having external threads 54 thereabout. The cylindrical reservoir 34 has internal threads 56 in the open top end 36. The collar 46 can screw into and screw off of the open top end 36 of the cylindrical reservoir 34.

Figures 5, 6:
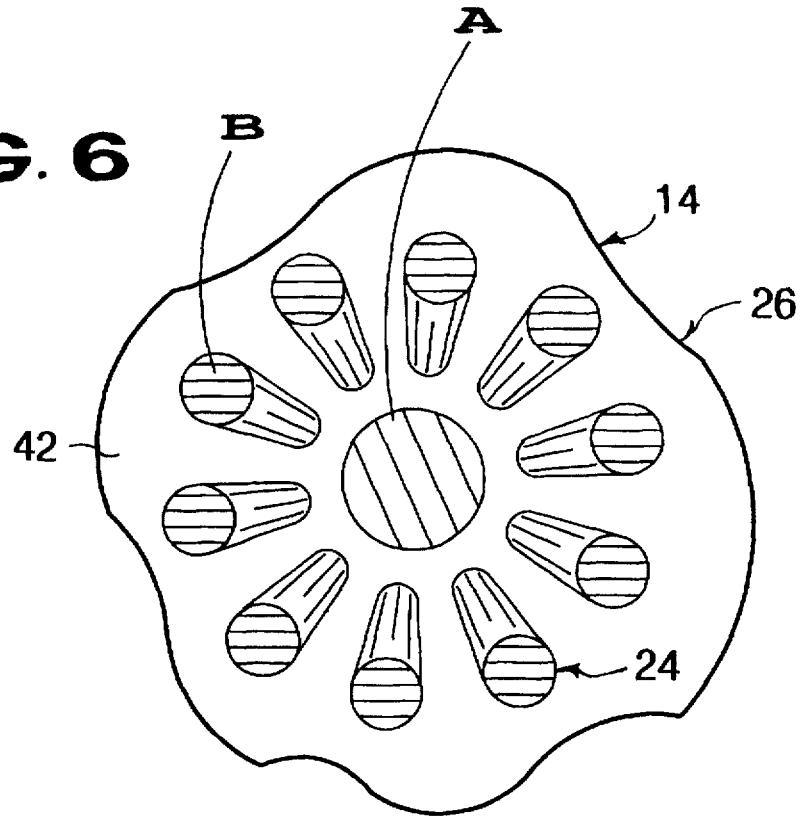
FIG. 5 is a chart for identifying the bristles in FIG. 6.
FIG. 6 is a still further enlarged diagrammatic cross sectional view taken along line 6—6 in FIG. 4 through the bristles.

As best seen in FIGS. 4 and 6, and listed in chart 58 in FIG. 5, some of the bristles 24 are hollow types "A" and extend downwardly from and communicate with the perforated bottom wall 42 of the head 14 to carry the flea powder 20 down to the hide of the animal 30. Some of the bristles 24 are solid types "B" and extend downwardly from the perforated bottom wall 42 of the head 14 about each hollow type, to brush the flea powder 20 into the hair of the animal 30.

The cylindrical reservoir 34 is fabricated out of a strong durable material 60. The collar 46 of the bellows cap 44 is fabricated out of a strong durable material 62. The flexible convex crown 50 is fabricated out of a strong durable material 64.

The strong durable material 32, 60 and 62 can be metal, as shown in FIG. 4, or plastic, wood and hard rubber. The strong durable material 64 can also be metal, as shown in FIG. 4, or soft plastic, soft rubber or a cloth membrane. The animal 30, as shown in FIG. 1, is a dog. Other hair bearing animals, such as cats (especially long haired types), rabbit, horses, cows, etc. can benefit from the use of the flea powder brush 10.

OPERATION OF THE INVENTION

To use the flea powder brush 10, the following steps should be taken:

1. Unscrew the external threads 54 on the collar 46 of the bellows cap 44 from the internal threads 56 in the to end 36 of the cylindrical reservoir 34 (see FIG. 3).
2. Deposit flea powder 20 into the cylindrical reservoir 34 (see FIG. 3).
3. Screw the external threads 54 on the collar 46 of the bellows cap 44 back into the internal threads 56 in the top end 36 of the cylindrical reservoir 34 (see FIG. 2).
4. Grasp the handle 12 by the hand 13 and position the thumb 45 over the flexible convex crown 50 (see FIG. 1).
5. Agitate the bristles 24 into the hair and hide of the animal 30 (see FIG. 1).
6. Depress the flexible convex crown 50 with the thumb 45, so that some of the flea powder 20 can exit out of the hollow type "A" bristles and mix into the hair and hide of the animal 30 (see FIG. 1).

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. A flea powder brush comprising:

a) a handle to be grasped by a hand of a person;

b) a head having a chamber therein extending from one end of said handle;

c) means for holding flea powder on said head comprising a cylindrical reservoir housing having an open top end and an open bottom end affixed onto said head;

d) first means for communicating between said holding means and said chamber within said head comprising a perforated top wall of said head;

e) a plurality of bristles extending downwardly from said head;

f) second means communicating between said chamber within said head and said bristles comprising a perforated bottom wall of said head;

g) means for manually forcing some of the flea powder within said holding means through said first communicating means, into said chamber within said head, through said second communicating means and into said bristles, so that the flea powder can be brushed into the hair and hide of an animal, said manually forcing means comprising a bellows cap on said open top end of said cylindrical reservoir depressable by a thumb of the hand grasping said handle;

h) said bellows cap comprising a collar, threadable means for engaging said collar onto said open top end of said cylindrical reservoir in a removable manner, and a flexible convex crown extending upwardly from said collar, said bellows cap having a one-way air valve in said flexible convex crown to allow said flexible convex crown to function as a hand pump; and i) said bristles being formed into an array of spaced clumps, each clump having a hollow bristle extending down from and communicating with a perforation in said bottom wall of said head surrounded by a plurality of solid bristles greater in length than said hollow bristle so that flea powder passing through said hollow bristle can be spread by said solid bristles surrounding each hollow bristle.

* * * * *